US005575584A

United States Patent [19]

Alsop

[11] Patent Number: 5,575,584

[45] Date of Patent: Nov. 19, 1996

[54] UNDERWATER SOIL EROSION PREVENTION SYSTEM

[75] Inventor: Peter Alsop, Kent, England

[73] Assignee: Marine Environmental Solutions, L.L.C., Calverton, Md.

[21] Appl. No.: 284,015

[22] Filed: Aug. 1, 1994

[51] Int. Cl.[6] ..... E02B 3/04

[52] U.S. Cl. ..... 405/24; 405/25

[58] Field of Search ..... 405/24, 25, 28, 405/32, 23, 21

[56] References Cited

U.S. PATENT DOCUMENTS

| | | | |
|---|---|---|---|
| 4,337,786 | 3/1984 | Morrisroe | 405/24 |
| 4,490,071 | 12/1984 | Morrisroe | 405/24 |
| 4,534,675 | 8/1985 | Morrisroe | 405/24 |
| 4,641,997 | 2/1987 | Lauer et al. | 405/24 |
| 4,710,057 | 12/1987 | Laier | 405/30 |
| 4,722,639 | 2/1988 | Alsop | 405/25 |
| 5,007,766 | 4/1991 | Freed et al. | 405/24 |
| 5,056,956 | 10/1991 | Nicholson | 405/17 |
| 5,102,257 | 4/1992 | Creter | 405/25 |
| 5,113,792 | 5/1992 | Jones et al. | 119/3 |
| 5,141,359 | 8/1992 | Klockner | 405/26 |
| 5,158,395 | 10/1992 | Holmberg | 405/21 |
| 5,176,468 | 1/1993 | Poole | 405/23 |
| 5,176,469 | 1/1993 | Alsop | 405/24 |
| 5,257,878 | 11/1993 | Peterson | 405/15 |

FOREIGN PATENT DOCUMENTS

| | | | |
|---|---|---|---|
| 7710671 | 4/1979 | Netherlands | 405/25 |
| 789795 | 1/1958 | United Kingdom . | |
| 8805842 | 8/1988 | WIPO . | |

*Primary Examiner*—Hoang C. Dang
*Attorney, Agent, or Firm*—Jenner & Block

[57] ABSTRACT

An underwater soil erosion prevention system has a generally rectangular length of material folded at regularly spaced intervals at an angle generally perpendicular to the longitudinal axis of the rectangular length of material, thereby forming sheets. Each sheet contains slits which are generally perpendicular to the fold. The slits begin above the bottom edge of the sheet and terminate below the top edge of the sheet. The sheets contain openings sized to snugly receive an anchor line on either side. To aid in deploying the soil erosion prevention system, an inflatable rollable array with a receiving valve is provided. The array can be rolled together with the underwater soil erosion prevention system, and when ready for deployment, a fluid is controllably inserted into the array through the receiving valve, thereby causing the array and system to unroll. Alternatively, the underwater soil erosion prevention system can be releasably attached to a frame mechanism to facilitate deployment underwater.

12 Claims, 4 Drawing Sheets

UNDERWATER SOIL EROSION PREVENTION SYSTEM

BACKGROUND OF THE INVENTION

1. Field of the Invention

This invention relates generally to an underwater soil erosion prevention system, and a method of deploying the same using an inflatable, rollable array.

2. Description of the Related Art

Devices used to prevent underwater soil erosion and cause soil deposition are known. Typical devices include buoyant frond elements or artificial seaweed anchored underwater in the area in which soil erosion (i.e., seafloor scour) is to be prevented. These devices operate by exerting a viscous drag on the underwater current, which reduces the velocity of the current and of soil particles transported by the current to a level where the soil particles settle out of the current and are deposited around the soil erosion prevention device.

For example, U.S. Pat. No. 5,176,469 to Alsop discloses a structure comprising a continuous sequence of buoyant fronds arranged side by side, each of which is attached to a base line wherein the line is folded back and forth to form frond sections. Each section is anchored to the ground through the base line.

Another example of an underwater soil erosion prevention system is shown in U.S. Pat. No. 4,722,639 to Alsop. In this system, an open grid mat structure is used as a base to attach a number of randomly overlapping elongate buoyant frond elements. The open grid mat structure requires the grid lines to be at least nine inches (9") apart from one another in practice. Spacing the grid lines, and thus frond elements, so far apart from one another limits the viscous drag exerted on the current and, thus, the structure's soil erosion prevention capabilities. In addition, the open grid mat disclosed in the foregoing patent is not adapted to be efficiently manufactured and deployed. A need exists for an easily manufactured and deployed device to exert a maximum amount of viscous drag (i.e., maximum wetted surface area) on the current to maximize soil erosion prevention.

Underwater soil erosion prevention systems must be deployed where they are to prevent soil erosion, which is often at great depths underwater. Deployment of such systems is difficult and costly. U.S. Pat. No. 5,176,469 to Alsop discloses an example of a deployment system in which an underwater soil erosion prevention system in the form of a continuous sheet folded back and forth from side to side is packed in a box-like dispenser with the sections in a compact state. When in the desired location for deployment, the leading edge of the soil erosion prevention system is pulled out and anchored down, and the box-like dispenser is advanced such that the compacted soil prevention system is thereby withdrawn and unpacked. One problem with this deployment system is that it requires divers to physically move the dispenser (which can be quite heavy) underwater, a difficult and time consuming process.

Another example of a deployment system is shown in U.S. Pat. No. 4,722,639. One end of each frond element disclosed therein is attached to an open grid mat structure, while the other end of each such frond element is allowed to float free. The open grid mat structure disclosed therein is rolled up, placed underwater in the desired location and physically unrolled by the divers deploying the system. Because of the loose individual frond elements, rolling up and unrolling this mat structure is difficult. Even if a net or other restraining device is used to restrain the unattached frond ends, this system is still difficult to roll because the frond elements disclosed therein are bulky and do not naturally lay flat. Deployment of this structure underwater by unrolling it is also difficult and labor intensive work.

A need exists for an easier deployment system to deploy underwater soil erosion prevention systems. Therefore, it is desirable to have a soil erosion prevention system which is effective in the field to prevent underwater soil erosion and a system for easily deploying it underwater.

SUMMARY OF THE PRESENT INVENTION

In accordance with the present invention, an underwater soil erosion prevention system is provided which exerts a viscous drag on water current, thereby slowing the velocity of the current and soil particles carried thereby, causing the soil particles to settle and preventing soil erosion in the immediate vicinity of the underwater soil erosion prevention system.

In accordance with the invention, an underwater soil erosion prevention system is provided which is made from lengths of continuous material folded to form multiple sheets, each sheet containing numerous parallel, vertical slits. Each sheet exerts a viscous drag on the water current. The sheets are preferably spaced about one inch apart from one another thereby providing a high density of sheets affecting current velocity. The slits are generally perpendicular to the folds, and terminate above the bottom edge and below the top edge of each sheet. Because no loose strands of material are created, the present invention provides a sturdy and durable device.

In accordance with the present invention, an underwater soil erosion prevention system is provided comprising a rectangular length of material with a multitude of folds generally perpendicular to the longitudinal axis of the material, wherein each two successive folds define a sheet. Each sheet contains a number of generally parallel slits, the slits being generally perpendicular to the folds. The material may be buoyant, i.e., may have a specific gravity of less than 1.0 $g/cm^3$. If the material is not buoyant, i.e., it has a specific gravity greater than 1.0 $g/cm^3$, then a buoyant material can be attached to the first material, preferably near the top edge of each sheet.

Each sheet can contain one or more openings aligned with the openings on successive sheets. The openings preferably are located near the bottom edge of the sheets. Each opening is sized to snugly receive a line, such line preferably being made of polypropylene or polyester. Because of the angle of the sheets with respect to the line, the line is wedged into the openings, further minimizing movement of the sheets along the line. Preferably, the sheets are spaced about one inch apart on average along the line. The line can be attached to anchors directly or to straps that are attached to anchors, which may be positioned in the ground to prevent the underwater soil erosion prevention system from undesired movement.

In accordance with a further aspect of the present invention, an inflatable rollable array for use in deploying an underwater soil erosion prevention system is provided, wherein hydraulic forces are used to effect deployment. The array can be made of a generally fluid impermeable material and includes at least one receiving valve. Alternatively, the array need not be completely fluid impermeable, so long as it holds fluid with sufficient pressure to cause the array to unroll. The receiving valve allows for the controlled insertion of water or other fluid into the array. The array can include one or more tubes which can be interconnected to one another in a variety of desired configurations.

The deflated array can be rolled up together with the underwater soil erosion prevention system (i.e., the way a carpet and pad can be rolled up together into one roll) for stowage or transport. The combined roll can be placed where the underwater soil erosion prevention system is to be deployed. Water or other fluid then can be controllably inserted into the array through the control valve. As water or other fluid is inserted into the array, the hydraulic pressure inflates the array and forces it to unroll, thereby unrolling the underwater soil erosion prevention system along with it.

In accordance with another aspect of the invention, the underwater soil erosion prevention system can also be deployed by use of a frame structure. In this method of deployment, the underwater soil erosion prevention system can be laid open out of the water and releasably secured to a suitably sized frame. The framed underwater soil erosion prevention system then can be moved to the desired location and anchored. The frame then is released for reuse.

DETAILED DESCRIPTION OF THE PREFERRED EMBODIMENTS

1. THE UNDERWATER SOIL EROSION PREVENTION SYSTEM

Figure 1:
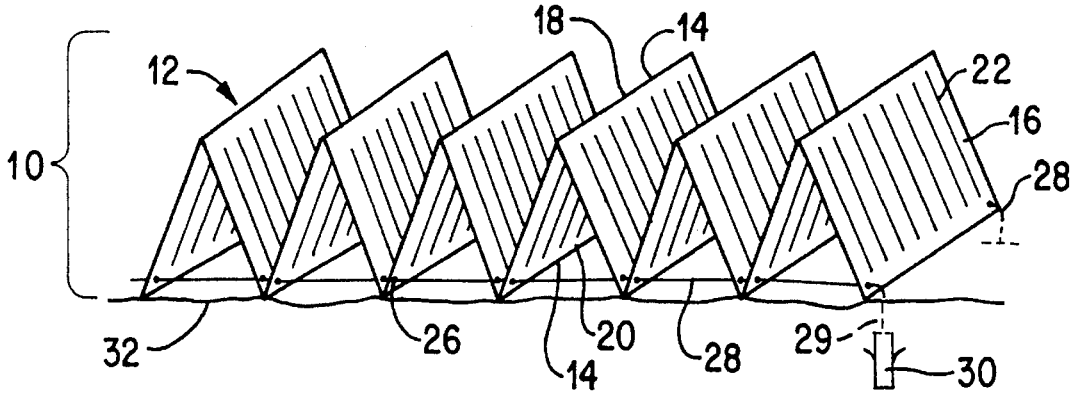
FIG. 1 is a perspective view showing schematically a portion of an underwater soil erosion prevention system with anchor lines.

Turning to the drawings, FIG. 1 shows schematically a perspective view of a portion of the underwater soil erosion prevention system 10 of the present invention, composed of a rectangular length of material 12 with folds 14 to form sheets 16, each with a top edge 18 and a bottom edge 20. Folds 14 are generally perpendicular to the longitudinal axis of material 12. The portion of material 12 which is between every two successive folds 14 defines a sheet 16. Each fold 14 creates either a top edge 18 or a bottom edge 20 for two successive sheets 16. Material 12 can be made of any suitable material, and is preferably made of thin film polypropylene about 0.001 inch to 0.010 inch thick, preferably about 0.0024 inch thick. The preferred polypropylene material 12 to be used is commercially available as SHP from Courtaulds Films (Holdings) Ltd., Registered Office: Bath Road, Bridgewager, Somerset TA6 4PA, United Kingdom. SHP is a multilayered thin film polypropylene material having a core filled with a material having a specific gravity of less than 1.0 g/cm$^3$ (i.e., about 0.574 ounce/inch$^3$). SHP has a specific gravity between 0.62 g/cm$^3$ and 0.69 g/cm$^3$ and thus is buoyant underwater.

Material 12 can be of any length and width desired to create an underwater soil erosion prevention system of any length, width and height. Considerations concerning materials availability, manufacturing and deployment of system 10 may affect the desired dimensions of material 12. Material 12 is preferably of a length such that, when folded to create sheets of a desired height that are spaced apart from one another in a desired pitch, the resulting length is about 5 meters. A preferable size of system 10 for purposes of manufacturing and deployment is about 5 meters by 5 meters (i.e., about 16.4 feet×16.4 feet) by about 1.37 meters (54 inches) high, with each sheet 16 spaced an average of about 2.5 cm (1 inch) apart from each successive sheet 16. To provide a system 10 with the above dimensions, material 12 should be about 270 meters (i.e., about 885 feet) long before folding. When material 12 is about 270 meters long, it can be folded about 194 times to make about 195 sheets 16 about 1.37 meters (54 inches) high. To provide a system 10 about 5 meters long, a preferred pitch or sheet separation distance is on average about 2.54 cm (1 inch) between successive sheets 16, or 5 cm between successive top edges 18 or bottom edges 20, respectively. For ease of manufacturing, material 12 is preferably about 2.5 meters wide. To provide a system 10 that is wider than 2.5 meters, additional units of material 12 (each about 2.5 meters wide) are fastened to one another side-by-side. Further, in addition to system 10 comprising multiple units set side-by-side, multiple units can be placed in front of or behind other units to cover the entire area to be protected from underwater soil erosion.

Figure 2:
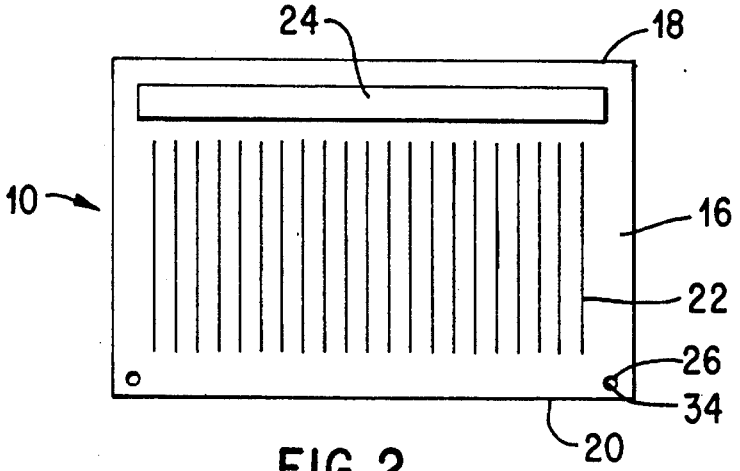
FIG. 2 is a schematic front view of an underwater soil erosion prevention system.

In an alternative embodiment, material 12 comprises a material having a specific gravity of greater than 1.0 g/cm$^3$ (i.e., which does not float in water). In that embodiment, sheets 16 do not float so as to maintain the desired, generally upright position underwater, without assistance. Therefore, as best seen in FIG. 2, a buoyant material 24 is attached to sheets 16 near top edge 18. The buoyant material 24 can comprise any material having a specific gravity sufficiently less than 1.0 g/cm$^3$ to enable the sheet 16 with the buoyant material 24 attached thereto to float upwards underwater. Examples of suitable materials include a closed cell foam material, cork, wood, air pockets heat sealed onto the sheets 16, or preferably strips of adhesive containing small, hollow glass spheres known as Microspheres, which are available commercially from Dow Corning Corporation, South Saginaw Road, Midland, Mich. 48686. The hollow spheres preferably have a specific gravity of about 0.27 g/cm$^3$.

Each sheet 16 contains slits 22 preferably spaced about 2.54 cm (1 inch) apart. Slits 22 begin a short distance above bottom edge 20 and terminate a short distance below top edge 18. In the alternative embodiment, slits 22 preferably terminate at a distance below top edge 18 sufficient to allow buoyant material 24 to be adhered near the top edge of sheet 16 without overlapping any slits 22. In either embodiment, slits 22 preferably terminate a sufficient distance from top edge 18 or bottom edge 20 to reduce the susceptibility of the slits 22 to tearing through respective top edge 18 or bottom edge 20, thus allowing sheets 16 to maintain their integrity. Slits 22 are preferably perpendicular to folds 14 (and therefore are also preferably perpendicular to top edge 18 and bottom edge 20). As an example, on a sheet measuring about 54 inches (or about 1.37 meters) tall, the slits 22 may be about 48 inches long, ending about 3 inches from top edge 18 and about 3 inches from bottom edge 20.

Each sheet 16 contains an opening on either side of the bottom edge. Openings 26 are aligned with respective openings 26 on either side of successive sheets 16. As shown in FIG. 1, openings 26 are sized to snugly receive a line 28, which can be connected directly or indirectly to an anchor device 30 to anchor the underwater soil erosion prevention system 10 to the ground or seabed 32 at the desired location. When sheets 16 are placed on line 28, top edges 18 of successive sheets 16 are spaced some distance 36 apart, such distance 36 preferably being about two inches (See FIG. 3). In such a configuration, bottom edges 20 of successive sheets 16 likewise are also spaced about 2 inches apart.

Figure 3:
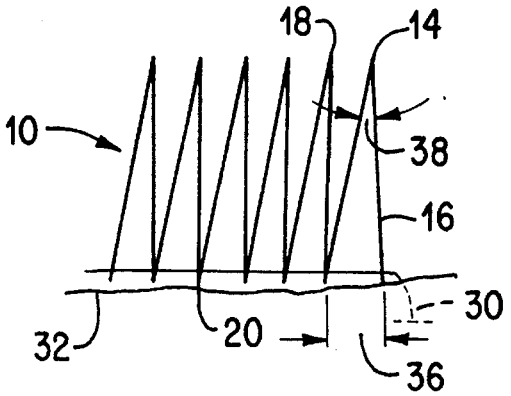
FIG. 3 is a schematic side view of a portion of an underwater soil erosion prevention system with an anchor line.

Anchor line 28 is preferably composed of woven polyester or polypropylene rope. Due to the elastomeric nature of preferred material 12, openings 26 can be stretched during assembly with a steel or other rigid rod or cylinder (not shown) to assist in threading anchor line 28 through openings 26. When the rigid rod is removed, stretched openings 26 shrink onto anchor line 28 to fit snugly enough to restrain movement of the respective sheet 16 along anchor line 28. With reference to FIG. 3, when sheets 16 have a pitch of about 2 inches, the angle 38 formed between successive sheets 16 is highly acute, on the order of less than about 3° for sheets that are about 54 inches tall. The angle 38 between sheets 16 serves to wedge each opening 26 against anchor line 28. The snug fit and wedging action both minimize undesired movement of sheets 16 with respect to anchor line 28 and assist in keeping the desired pitch of sheets 16.

Use of a two-inch pitch places each sheet 16 close to each successive sheet 16, creating a high density of sheets 16. The high density of sheets 16 causes the current velocity to be slowed more by the present system than previously known soil erosion prevention devices, thereby causing more soil to settle and deposit, and further reducing soil erosion. However, the spacing between sheets 16 (their pitch) can be set as desired so as to maximize effectiveness for preventing soil erosion for any given set of conditions (e.g., velocity of the underwater current, average size of soil particles carried by the current, etc.).

When out of water, system 10 can be folded substantially flat by laying successive sheets against one another. However, when underwater, sheets 16 float upward due to their buoyant state. Because sheets 16 may float upward when underwater before the installer is ready for sheets 16 to do so, a restraining device such as a net (not shown) can be placed over the sheets to restrain them until after system 10 has been anchored at the desired location on the seabed 32. A net can be releasably attached to system 10 and placed over sheets 16 and then removed when system 10 has been positioned in the desired location on the seabed 32. Floatable buoys (not shown) can be attached to the net to cause the net to float to the surface for retrieval.

Anchor line 28 can be attached directly to anchor 30, or indirectly via an anchor strap 29. Anchoring devices are known in the art. Suitable anchoring systems are described in U.S. Pat. Nos. 5,255,480 and 4,738,063, each to Alsop. Also, another suitable anchoring system is described in application entitled "Ground Anchoring System," Ser. No. 08/284,012, by the same inventor as the present application, filed Aug. 1, 1994.

2. STOWAGE AND TRANSPORT

Figure 6:
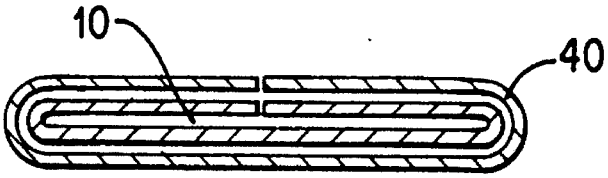
FIG. 6 is a schematic front view of an inflatable rollable array folded along two longitudinal axes together with an underwater soil erosion prevention system.
Figure 7:
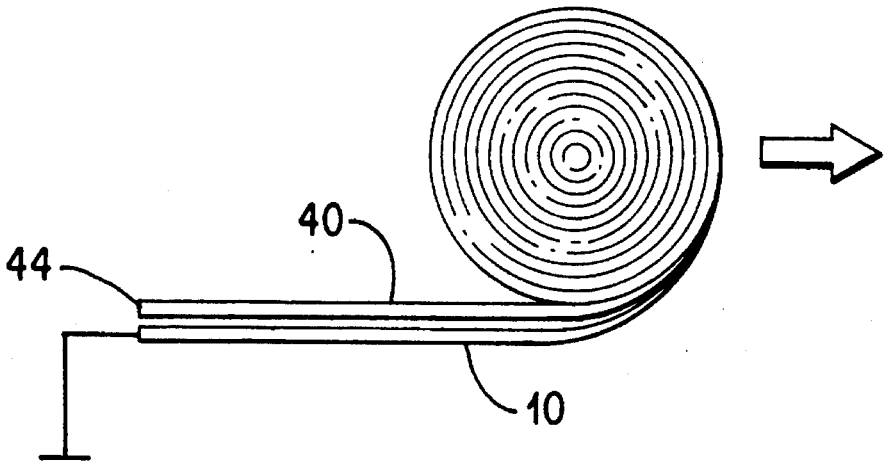
FIG. 7 is a schematic side view of a partially unrolled inflatable array that has been rolled up together with an underwater soil erosion prevention system, which combination has been partially unrolled by hydraulic pressure created by fluid being inserted into the array.
Figure 8:
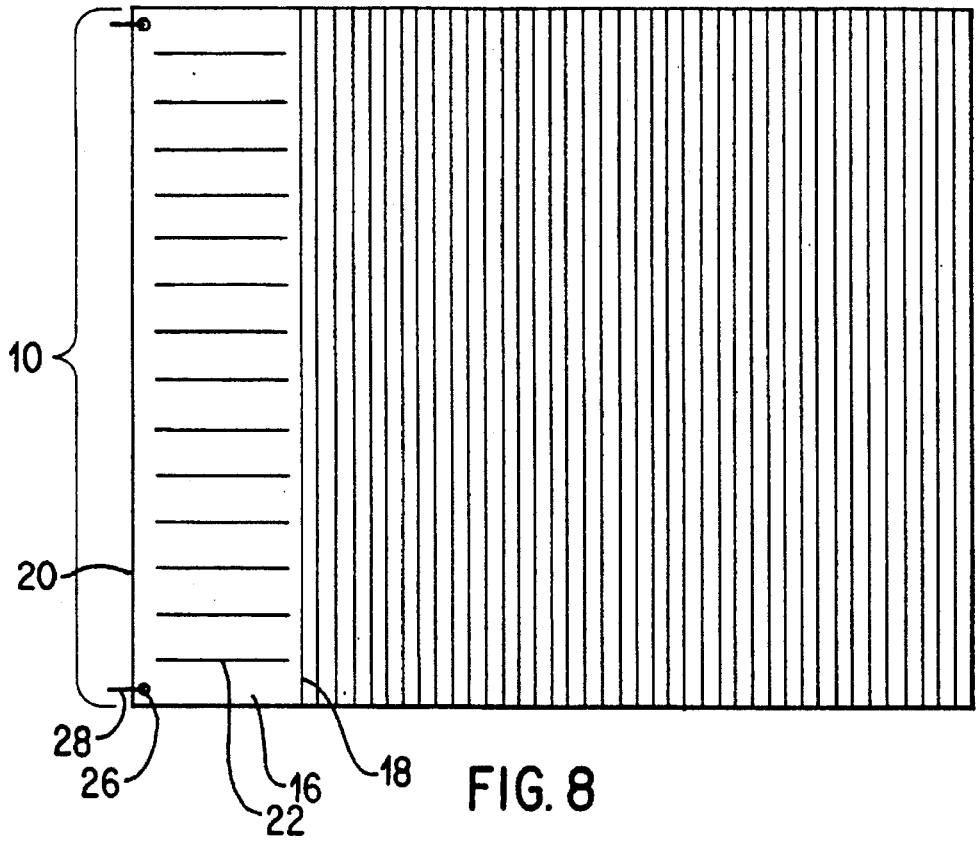
FIG. 8 is a schematic top view of an underwater soil erosion prevention system laid substantially flat.

FIG. 8 shows a top view of system 10 unfolded and unrolled and lying substantially flat. Each sheet 16 substantially overlaps successive sheets 16. Bottom edges 20 are spaced along anchor line 28 in a preselected pitch. To assist in moving or storing underwater soil erosion prevention system 10, it can be folded, rolled or both. For example, FIG. 6 shows a front view of underwater soil erosion prevention system 10 with its sides folded over along two longitudinal axes, reducing its width. FIG. 7 shows a side view of underwater soil erosion prevention system 10 partially unrolled. Additionally, system 10, shown folded in FIG. 6, for example, can be rolled as shown in FIG. 7. Folding or rolling system 10 compacts it, thus making it easier to store and transport.

3. DEPLOYMENT

A. The Inflatable Rollable Array

Figure 4:
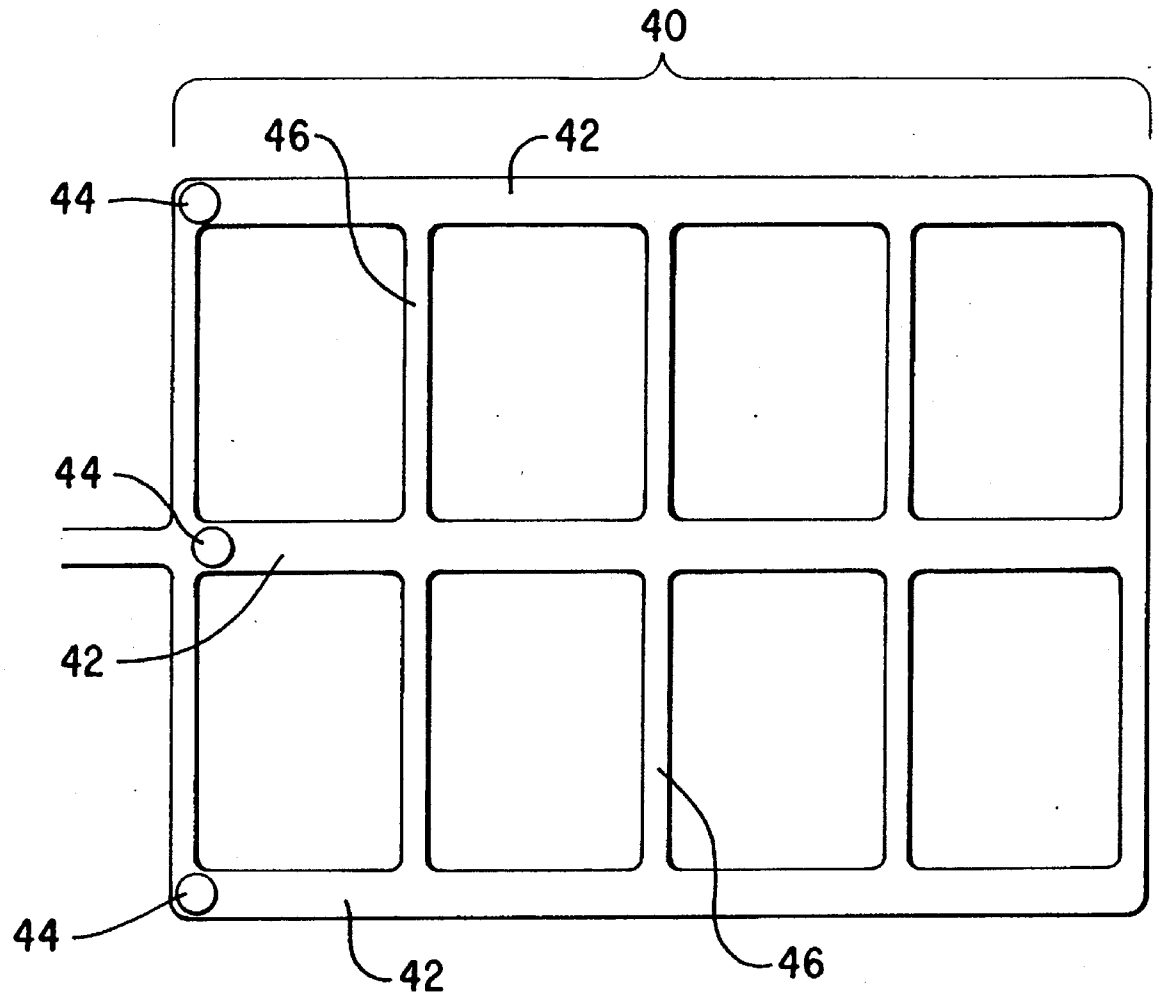
FIG. 4 is a schematic top view of an inflatable rollable array for use with a rollable object, such as an underwater soil erosion prevention system.

FIG. 4 shows schematically a top view of an inflatable, rollable array 40 comprising an inflatable tube 42 and one or more receiving valves 44. The inflatable tube 42 can comprise one or more separate tubes or an interconnected array of tubes, each tube 42 being interconnected to one another by use of interconnecting tubes 46. Receiving valve 44 allows for the controlled insertion of a fluid, preferably water when the device is being used underwater. The controlled insertion of water into array 40 can be accomplished through use of a standard, commercially available water pump (not shown) suitable for use underwater. Preferably, array 40 is made of a thin film plastic material such as polypropylene or preferably polyethylene which is about 80 microns to 100 microns thick. It is preferable to use light material to construct array 40 to make it easier to handle and move underwater.

The array 40, while deflated, is placed so as to lie beneath or on top of system 10, with system 10 lying flat as illustrated in FIG. 8. FIGS. 5*a*, 5*b*, 6 and 7 illustrate schematically array 40 positioned on top of, or underneath, system 10. System 10 and array 40 are then rolled up together for stowage and transport to the underwater location where system 10 is to be deployed. As shown schematically in FIG. 7, after system 10 with array 40 has been positioned where desired on the seabed 32, fluid can be controllably inserted into array 40 through use of receiving valve 44 and a suitable pump (not shown). As fluid is inserted into rolled up array 40, hydraulic pressure forces rolled up array 40 to unroll. As array 40 unrolls, it also forces underwater soil erosion prevention system 10, which is rolled up with array 40, to unroll. (It is understood that as used herein the term "roll" includes, without limitation, the concept of "fold".)

Array 40, as shown in FIG. 4, is structured to deploy a single unit of underwater soil erosion prevention system 10. It is understood that any desired configuration of array 40 can be used, and more than one unit of an underwater soil erosion prevent system 10 can be deployed simultaneously with one or more arrays 40. Folding or rolling up the soil erosion prevention system 10 and deployment array 40 together facilitates stowage and transport prior to deployment on an underwater seabed 32.

Figure 5A:
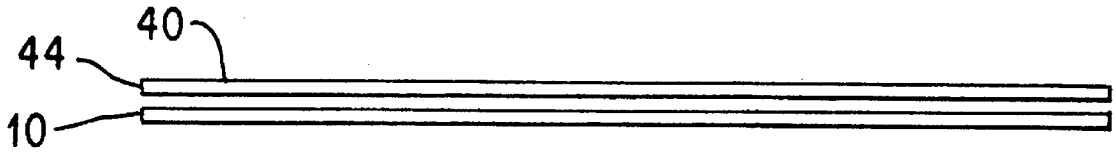
FIG. 5*a* is a schematic side view of a multi-use unrolled inflatable rollable array in position on top of a rollable underwater soil erosion prevention system.
Figure 5B:
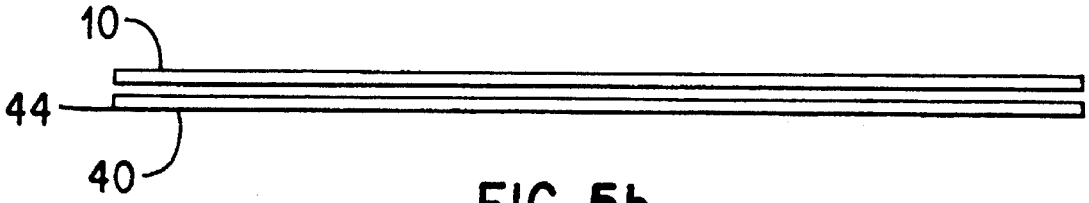
FIG. 5*b* is a schematic side view of a single-use unrolled inflatable rollable array in position under a rollable underwater soil erosion prevention system.

Array 40 can be a single-use device which is permanently attached to underwater soil erosion prevention system 10, or a reusable device that is releasably attached to underwater soil erosion prevention system 10. In the event array 40 is a single-use device, it is preferable to place system 10 on top of array 40, as shown in FIG. 5*b*, so as not to interfere with sheets 16 floating upward after deployment underwater. In the event array 40 is reusable, and thus will be removed from system 10, it is preferable to place array 40 on top of system 10, as shown in FIG. 5*a*, to allow the easy removal of array 40 after system 10 is deployed (not shown).

When deploying underwater soil erosion prevention system 10 using a single-use array 40, a diver can anchor array 40 and underwater soil erosion prevention system 10 to the ground using a suitable anchor 30. Alternatively, underwater soil erosion prevention system 10 can be anchored to the ground by itself, and the reusable array 40 can be unattached and removed for reuse. If underwater soil erosion prevention system 10 is not properly anchored to the ground, it may be carried by the current or other forces away from the desired deployment location (because sheets 16 are inherently buoyant or are made buoyant by the addition of buoyant material 24).

B. Frame

Figure 9:
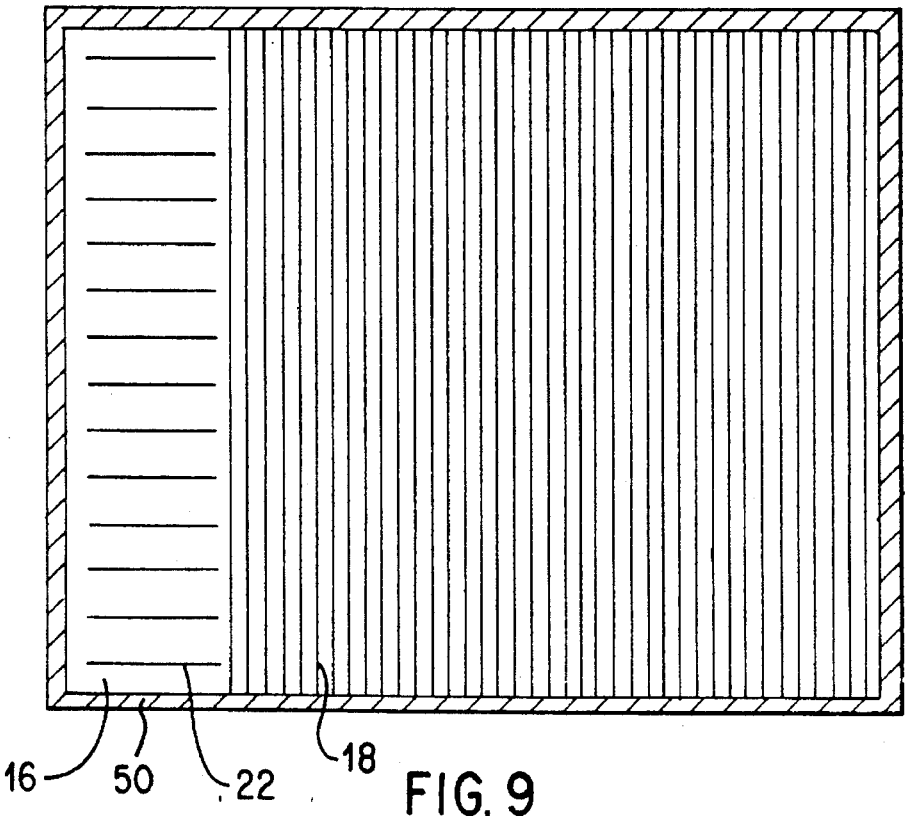
FIG. 9 is a schematic top view of an underwater soil erosion prevention system laid substantially flat with a frame on top of such system and extending substantially around the system's periphery.

As shown in FIG. 8, system 10 when unfolded and unrolled out of water can be laid substantially flat. With reference to FIG. 9, a frame 50 is sized to extend substantially around the periphery of unfolded and unrolled system 10. System 10 can be releasably attached to frame 50. Mounted to frame 50, system 10 can be more easily transported to the underwater location on the seabed 32 where system 10 is to be deployed. After system 10 has been anchored to the ground or seabed 32 at the desired deployment location, frame 50 can be released from system 10 and reused. If more than one unit of system 10 is to be deployed at one time, a larger frame 50 or additional frames 50 can be used as needed. Frame devices to deploy underwater soil erosion prevention systems are known. For example, PCT WIPO application International Publication No. WO 88/05842 to Alsop discloses such a device.

Whereas the present invention has been described with respect to specific embodiments thereof, it will be understood that various changes and modifications will be suggested to one skilled in the art and it is intended that the invention encompass such changes and modifications as fall within the scope of the appended claims.

What is claimed is:

1. An underwater soil erosion prevention system comprising:

a generally rectangular length of material having at least two folds, each fold being generally perpendicular to the longitudinal axis of the rectangular length of material;

wherein said folds form a plurality of successive sheets in the rectangular length of material;

wherein one of the folds defines a top edge of two successive sheets and a successive fold defines a bottom edge of two successive sheets such that the portion of the rectangular length of material between two successive folds comprises a single sheet;

wherein the top edge of each sheet is substantially parallel to the bottom edge of the same sheet;

wherein each sheet contains at least one slit, said slit beginning above the bottom edge of the sheet and terminating below the top edge of the sheet; and wherein said slit is generally perpendicular to the fold.

2. The underwater soil erosion prevention system of claim 1 wherein said rectangular length of material comprises a multilayered thin film polypropylene material having a specific gravity of less than 1.0 g/cm$^3$.

3. The underwater soil erosion prevention system of claim 1 wherein said multilayered thin film polypropylene material has a specific gravity between 0.62 g/cm$^3$ and 0.69 g/cm$^3$.

4. The underwater soil erosion prevention system of claim 1 wherein the rectangular length of material comprises polypropylene about 1 mil to 10 mils thick.

5. The underwater soil erosion prevention system of claim 1 wherein the rectangular length of material comprises polypropylene about 2.4 mils thick.

6. The underwater soil erosion prevention system of claim 1 wherein the rectangular length of material comprises material with a specific gravity of less than 1.0 g/cm$^3$.

7. The underwater soil erosion prevention system of claim 1 wherein each sheet comprises:

a first material which has a specific gravity greater than 1.0 g/cm$^3$;

wherein said sheets have a second material with a specific gravity less than 1.0 g/cm$^3$ attached substantially near each top edge; and wherein the sheets bearing the second material are substantially buoyant underwater.

8. The underwater soil erosion prevention system of claim 1 wherein each successive sheet contains at least one aligned opening situated to receive snugly a line.

9. The underwater soil erosion prevention system of claim 1 wherein the angle formed between successive sheets is less than three degrees.

10. The underwater soil erosion prevention system of claim 1 wherein the distance between the bottom edges of successive sheets is about two inches.

11. The underwater soil erosion prevention system of claim 1 wherein each sheet contains a plurality of slits, wherein the slits are about one inch apart.

12. A method of deploying an underwater soil erosion prevention system, comprising the steps of:

releasably attaching a frame sized to extend substantially around the periphery of an unfolded, unrolled underwater soil erosion prevention system, wherein said underwater soil erosion prevention system comprises a generally rectangular length of material having at least two folds, each fold being generally perpendicular to the longitudinal axis of the rectangular length of material;

wherein said folds form a plurality of successive sheets in the rectangular length of material;

wherein one of the folds defines a top edge of two successive sheets and a successive fold defines a bottom edge of two successive sheets such that the portion of the rectangular length of material between two successive folds comprises a single sheet;

wherein the top edge of each sheet is substantially parallel to the bottom edge of the same sheet;

wherein each sheet contains at least one slit, said slit beginning above the bottom edge of the sheet and terminating below the top edge of the sheet;

wherein said slit is generally perpendicular to the fold positioning the combined frame and underwater soil erosion prevention in a place where soil erosion is to be prevented;

positioning the underwater soil erosion prevention system;

anchoring the underwater soil erosion prevention system; and unattaching the frame.

* * * * *